US009032912B2

(12) United States Patent
Ma et al.

(10) Patent No.: US 9,032,912 B2
(45) Date of Patent: May 19, 2015

(54) AIR CONNECTOR FOR AN INTERNAL COMBUSTION ENGINE

(75) Inventors: Thomas Ma, Essex (GB); Hua Zhao, Buckinghamshire (GB)

(73) Assignee: BRUNEL UNIVERSITY, Uxbridge, Middlesex (GB)

( * ) Notice: Subject to any disclaimer, the term of this patent is extended or adjusted under 35 U.S.C. 154(b) by 0 days.

(21) Appl. No.: 13/883,062

(22) PCT Filed: Nov. 2, 2011

(86) PCT No.: PCT/IB2011/054853

§ 371 (c)(1), (2), (4) Date: Jun. 12, 2013

(87) PCT Pub. No.: WO2012/059865

PCT Pub. Date: May 10, 2012

(65) Prior Publication Data

US 2013/0255595 A1 Oct. 3, 2013

(51) Int. Cl.

| | |
|---|---|
| ***F02B 63/00*** | (2006.01) |
| ***F02B 21/00*** | (2006.01) |
| ***F02M 35/10*** | (2006.01) |
| *F02B 63/04* | (2006.01) |
| *F02B 77/13* | (2006.01) |
| *F02B 75/16* | (2006.01) |

(52) U.S. Cl.

CPC ..... *F02B 21/00* (2013.01); *F02B 63/04* (2013.01); *F02B 2063/045* (2013.01); *F02B 77/13* (2013.01); *F02B 75/16* (2013.01); *F02B 63/044* (2013.01); *F02M 35/10229* (2013.01)

(58) Field of Classification Search

CPC .. F02B 63/04; F02B 2063/045; F02B 63/044; F02B 77/13; F02B 75/16

USPC ..... 123/2

See application file for complete search history.

(56) References Cited

U.S. PATENT DOCUMENTS

| | | | | |
|---|---|---|---|---|
| 1,132,393 | A | 3/1915 | Schmucker | |
| 2,995,890 | A | 8/1961 | Dolza | |
| 7,231,998 | B1 | 6/2007 | Schechter | |
| 2004/0148932 | A1 | 8/2004 | Larson | |
| 2006/0162691 | A1 * | 7/2006 | Ishida et al. | 123/337 |
| 2008/0066708 | A1 | 3/2008 | Maruyama | |

* cited by examiner

FOREIGN PATENT DOCUMENTS

| | | |
|---|---|---|
| DE | 3117143 | 11/1982 |
| EP | 1308614 | 5/2003 |
| GB | 2430975 A * | 4/2007 |

*Primary Examiner* — Lindsay Low
*Assistant Examiner* — Charles Brauch
(74) *Attorney, Agent, or Firm* — Allen Dyer Doppelt Milbrath & Gilchrist

(57) ABSTRACT

An air connector is described mountable opposite an intake or exhaust port in an associated intake or exhaust pipe of an internal combustion engine to allow the port to communicate selectively with the associated pipe and with a compressed air storage tank. The connector comprises a stopper mounted on a rod movable by an actuator between an open position in which the port communicates with the associated pipe and a closed position in which the stopper seals around the entrance of the port to isolate the port from the associated pipe. An air passage is provided in the stopper and the rod to allow communication between the port and the compressed air storage tank when the stopper is in the closed position, and a check valve is arranged in the air passage and biased in a direction to prevent escape of air from the compressed air storage tank in all positions of the stopper.

7 Claims, 8 Drawing Sheets

AIR CONNECTOR FOR AN INTERNAL COMBUSTION ENGINE

CROSS-REFERENCE TO RELATED APPLICATIONS

This application is the §371 National Stage Entry of International Application No. PCT/IB2011/054853, filed on Nov. 2, 2011, which claims the benefit of Great Britain Patent Application 1018653.5, filed on Nov. 3, 2010, the contents of which applications are herein incorporated by reference in their entirety.

FIELD OF THE INVENTION

The present invention relates to an air connector mountable opposite an intake or exhaust port in an associated intake pipe or exhaust pipe of an internal combustion engine to allow the port to communicate selectively with the associated pipe and with a compressed air storage tank.

BACKGROUND OF THE INVENTION

Engine braking is commonly used in heavy goods vehicles in which the engine is temporarily converted into an energy absorber while being motored by the vehicle and the fuel to the engine is shut off. To increase the braking torque generated by this motored engine, an engine braking device, which is a temporarily operated valve actuating mechanism, is commonly installed in the engine for modifying the valve timing of the engine to allow the compression pressure, generated within the engine cylinder during the compression stroke of the engine, to be released irreversibly from the engine. Traditionally, the exhaust valve of the engine is kept opened during the compression stroke of the engine when the engine braking device is activated and the energy of the compressed air is released to the exhaust system of the engine. Similarly, the intake valve of the engine may be kept open during the compression stroke of the engine producing a similar engine braking effect but the energy of the compressed air is released to the intake system of the engine.

In either case, instead of wasting this compressed air energy generated during braking, it has been proposed to divert it to a compressed air storage tank so that it can be captured and re-used for various purposes in the vehicle after braking. This represents an air hybrid vehicle in which the engine is selectively operable is several modes, namely, normal fuel burning mode producing power for driving of the vehicle, air compressor mode absorbing power and producing compressed air during braking of the vehicle, and possibly, air motor mode re-using the captured compressed air to drive the engine.

In the above air hybrid vehicle when the engine is operating in the air compressor mode, the engine braking device acting on either the exhaust valve or the intake valve of the engine is activated to achieve compression release from the engine cylinder. At the same time, an air diverting device is required to capture the compressed air from the exhaust system or intake system of the engine, respectively. Such an air diverting device will have a similar function and design when installed in either location but the operating environment will have to be taken into account in view of the higher temperature of the exhaust system. In this context, it is preferred to transfer the installation of the engine braking device from its traditional position acting on the exhaust valve to a similar position acting on the intake valve producing similar engine braking effect, thus allowing the air diverting device to be installed in the intake system of the engine which will be more economical and durable.

SUMMARY OF THE INVENTION

The invention seeks to enable an engine to operate in a variety of modes while minimising the complexity of the air diverting device.

According to the present invention, there is provided an air connector mountable opposite an intake or exhaust port in an associated intake or exhaust pipe of an internal combustion engine to allow the port to communicate selectively with the associated pipe and with a compressed air storage tank, the connector comprising a stopper mounted on a rod movable by an actuator between an open position in which the port communicates with the associated pipe and a closed position in which the stopper seals around the entrance of the port to isolate the port from the associated pipe, wherein an air passage is provided in the stopper and the rod to allow communication between the port and the compressed air storage tank when the stopper is in the closed position, and a check valve is arranged in the air passage and biased in a direction to prevent escape of air from the compressed air storage tank in all positions of the stopper.

Preferably, the actuator is a pneumatic actuator comprising a pneumatic air cylinder connectable to receive compressed air from the compressed air storage tank, and a piston having an opening communicating between the air passage in the rod and the pneumatic air cylinder.

The piston should have an effective area larger than the air blockage area of the stopper such that the closing force exerted on the piston by the air pressure in the pneumatic air cylinder exceeds the opening force exerted on the stopper by the air pressure transmitted to or generated within the blocked intake port.

A return spring is preferably provided in the air connector to retract the stopper from the intake port entrance when the pneumatic air cylinder is disconnected from the compressed air storage tank and vented instead to the ambient atmosphere.

When the engine is operating in certain modes, it may be desired to allow air to flow from the compressed air storage tank into the intake port, i.e. in the opposite direction to that allowed by the check valve. This may be achieved by providing an externally mounted abutment for opening the check valve to allow flow in both directions when the stopper is in the closed position. Such an abutment may lift the valve closure member of the check valve off its valve seat for as long as the stopper remains in the closed position.

Referring to an engine with an engine braking device installed acting on an intake valve of the engine, an air connector as so far described may be used in a four-stroke internal combustion engine having two intake valves per cylinder and two separate intake ports leading to the respective intake valves. In such an engine, in addition to a normal mode of operation in which fuel is burnt to generate power and both intake ports communicate with their respective intake pipes or a common plenum, the engine is operable in at least one of two air hybrid modes, namely an air compressor mode and an air motor mode. In the air compressor mode air is drawn into the engine cylinder during the intake stroke of the engine by way of a first intake port and this air is supplied during the ensuing compression stroke of the engine to the compressed air storage tank by way of the second intake port which is closed by the stopper of an air connector. In the air motor mode, compressed air is supplied to the engine cylinder during the intake stroke from the compressed air storage tank by way of a first intake port while it is closed by the stopper of an air connector (the check valve in this mode being kept opened by an externally mounted abutment) and this air is discharged from the engine cylinder during the ensuing compression stroke of the engine by way of the second intake port.

In the above engine, the first intake valve is operated with a normal intake event during all modes of operation of the engine and the second intake valve is operated with a first valve event during the normal mode of operation of the engine and with a second valve event during the air compressor and air motor modes of operation of the engine.

The above engine is also operable in a temporary boost, fuel burning mode, for example to compensate for turbo lag or to provide short periods of high power operation. In this mode, both intake ports are blocked by respective air connectors and pressurised air is supplied from the compressed air storage tank to an intake port by way of an air connector of which the check valve is kept opened by an externally mounted abutment, both intake valves being operated with the valve events for normal mode operation of the engine.

The air connector may be used in another four-stroke internal combustion engine having only one intake valve per cylinder or multiple intake valves sharing a common or siamesed intake port. In such an engine, in addition to a normal mode of operation in which fuel is burnt to generate power and the intake port is open, the connector can enabled the engine to operate in an air compressor mode.

For this purpose, at least one additional flow passage is provided in the stopper for connecting the air space surrounding the intake port entrance with the interior of the intake port when the intake port is connected by the air connector, and a non-return valve is arranged in the additional flow passage for permitting air flow by way of the stopper into the intake port.

When operating in the air compressor mode, air is drawn into the engine cylinder during the intake stroke of the engine from the intake pipe by way of the non-return valve in the air connector, and this air is compressed and supplied by way of the check valve in the air connector to the compressed air storage tank during the ensuing compression stroke of the engine.

In the above engine, the intake valve is operated with a normal intake event during the normal mode of operation of the engine and is operated with a second valve event during the air compressor mode of operation of the engine.

The above engine is also operable in a temporary boost, fuel burning mode in which the intake port is blocked by an air connector and pressurised air is supplied from the compressed air storage tank to the intake port by way of a check valve in the air connector kept opened by an externally mounted abutment, while both intake valves are operated with the valve events for normal mode of operation of the engine.

BRIEF DESCRIPTION OF THE DRAWINGS

The invention will now be described further, by way of example, with reference to the accompanying drawings, in which.

DETAILED DESCRIPTION OF PREFERRED EMBODIMENTS

Whilst the air connector of the present invention may be mounted opposite either an intake or exhaust port of an engine working in conjunction with an associated engine braking device installed acting on an intake or exhaust valve respectively, the following description refers to an air connector mounted opposite an intake port of an engine working in conjunction with an engine braking device installed acting on an intake valve of the engine.

Figure 1:
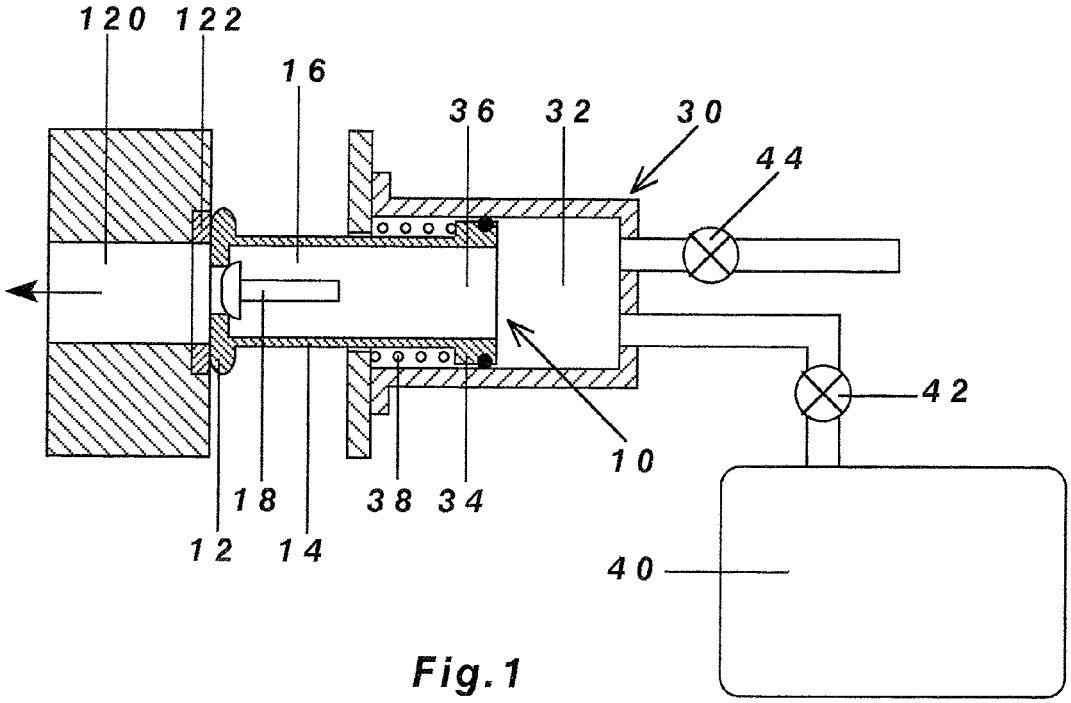
FIG. 1 is a schematic sectional representation of an air connector embodying the present invention.

FIG. 1 shows an air connector 10 mounted opposite an intake port 120 leading in the direction of the arrow to an intake valve of an engine cylinder to allow the intake port 120 to communicate selectively with the intake pipe outside the intake port 120 and with a compressed air storage tank 40. The connector 10 comprises a stopper 12 mounted on a rod 14 movable by an actuator 30 between an open position in which the intake port 120 communicates with the intake pipe and a closed position in which the stopper 12 seals around the entrance of the intake port 120 to isolate the intake port 120 from the intake pipe. In FIG. 1, the stopper 12 is pushed by the actuator 30 towards the entrance of the intake port 120 and pressed against a sealing element 122 surrounding the port entrance with a sufficient force to hold a tight seal around the port entrance. An air passage 16 is provided in the stopper 12 and the rod 14 to allow communication between the intake port 120 and the compressed air storage tank 40 when the stopper 12 is in the closed position. A check valve 18 arranged in the air passage 16 is biased in a direction to prevent escape of air from the compressed air storage tank 40 in all positions of the stopper 12.

The actuator 30 is a pneumatic actuator comprising a pneumatic air cylinder 32 connectable to receive compressed air from the compressed air storage tank 40, and a piston 34 having an opening 36 communicating between the air passage 16 in the rod 14 and the pneumatic air cylinder 32. In FIG. 1, the piston 34 is shown sealed for movement along the pneumatic air cylinder 32 by an O-ring. Alternatively it may be sealed for movement by a flexible diaphragm.

The piston 34 has an effective area larger than the air blockage area of the stopper 12 such that the closing force exerted on the piston 34 by the air pressure in the pneumatic air cylinder 32 exceeds the opening force exerted on the stopper 12 by the air pressure transmitted to or generated within the blocked intake port 120.

The actuator 30 further comprises a return spring 38 to retract the stopper 12 from the entrance of the intake port 120 when the pneumatic air cylinder 32 is disconnected from the compressed air storage tank 40 and vented instead to the ambient atmosphere.

Figure 1A:
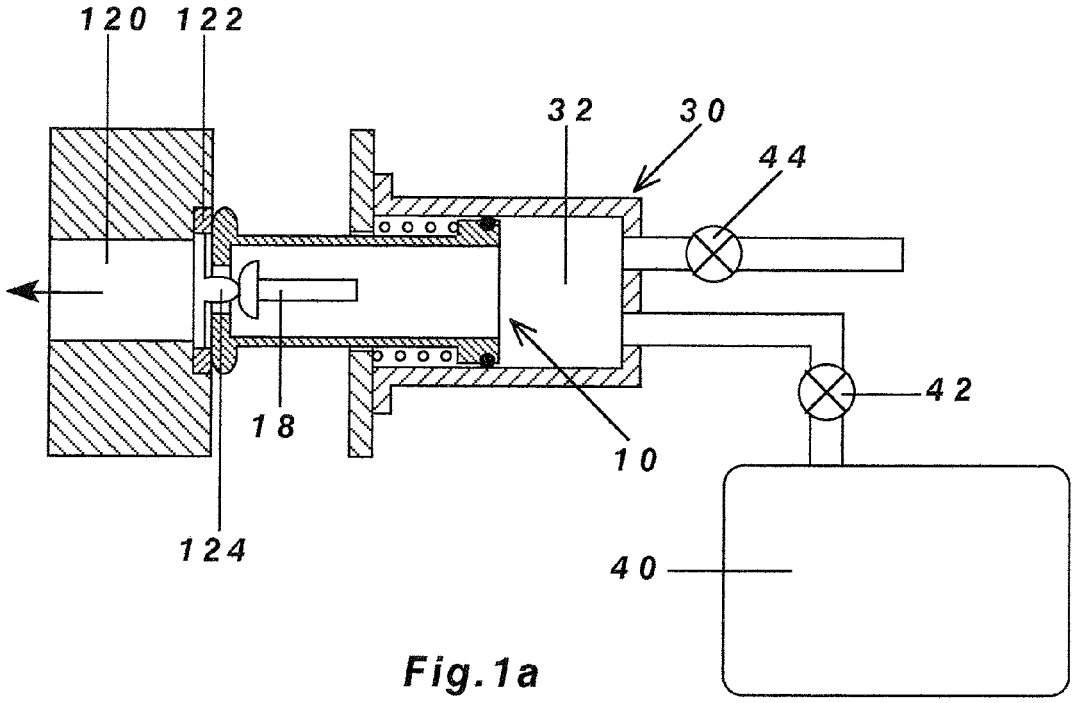
FIG. 1A is a schematic sectional representation of the air connector of FIG. 1, further including an abutment.

The check valve 18 includes a spring biased valve closure member operative to interact with an externally mounted abutment 124 to allow air flow in both directions when the stopper 12 is in the closed position. The abutment 124 is shown in FIG. 1*a* as a bar mounted across the sealing element 122 for stopping and lifting the check valve 18 as the stopper 12 approaches the sealing element 122 when it is pushed by the actuator 30 towards the entrance of the intake port 120.

Figure 2:
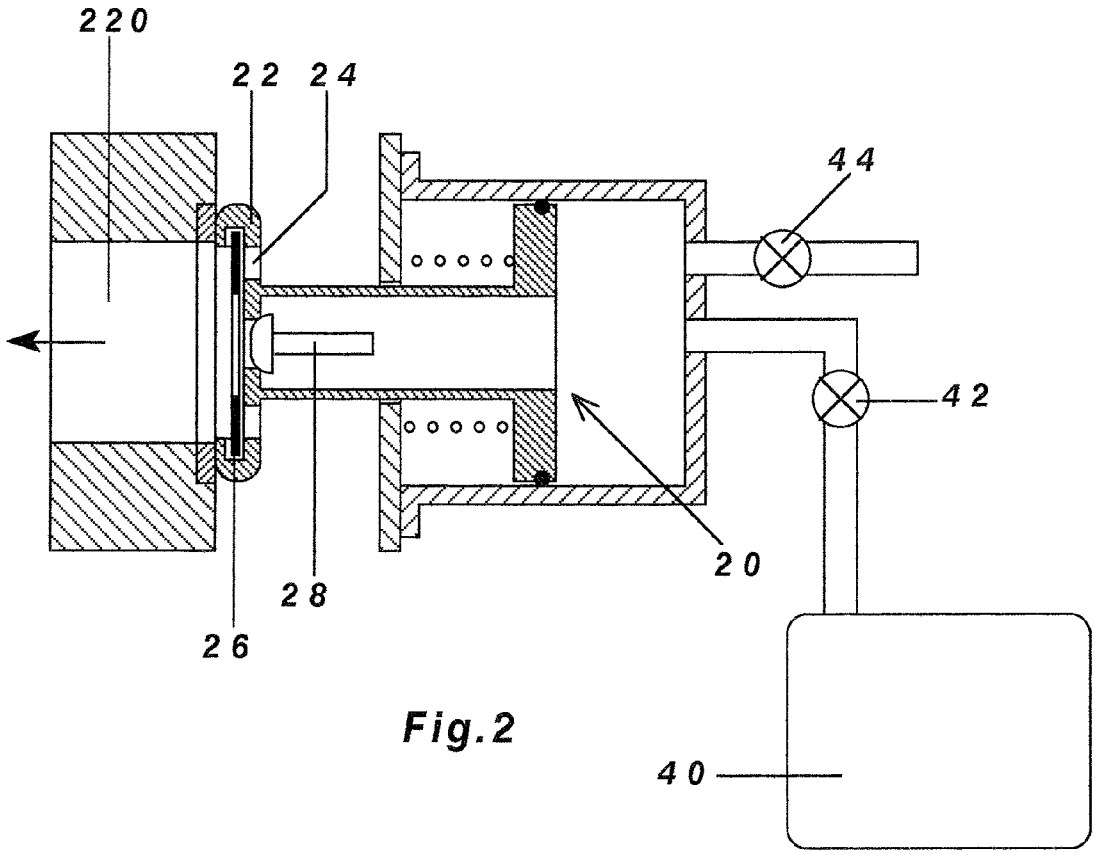
FIG. 2 is a schematic sectional representation of an alternative design of an air connector.

FIG. 2 shows an alternative design of an air connector 20 with a larger stopper 22 for blocking a larger intake port 220. The stopper 22 has additional flow passages 24 in an area surrounding the rod for connecting the air space outside the intake port 220 with the interior of the intake port 220 when the stopper 22 is in the closed position. A disc 26, positioned behind the flow passages 24, is arranged to function as a non-return valve which permits air flow from the intake pipe into the intake port 220 by way of the flow passages 24 and a central opening in the disc 26, and blocks any reverse flow from the intake port 220 towards the intake pipe.

The above air connector 10 or 20 may be used in an internal combustion engine in a variety of operating modes.

Figure 3:
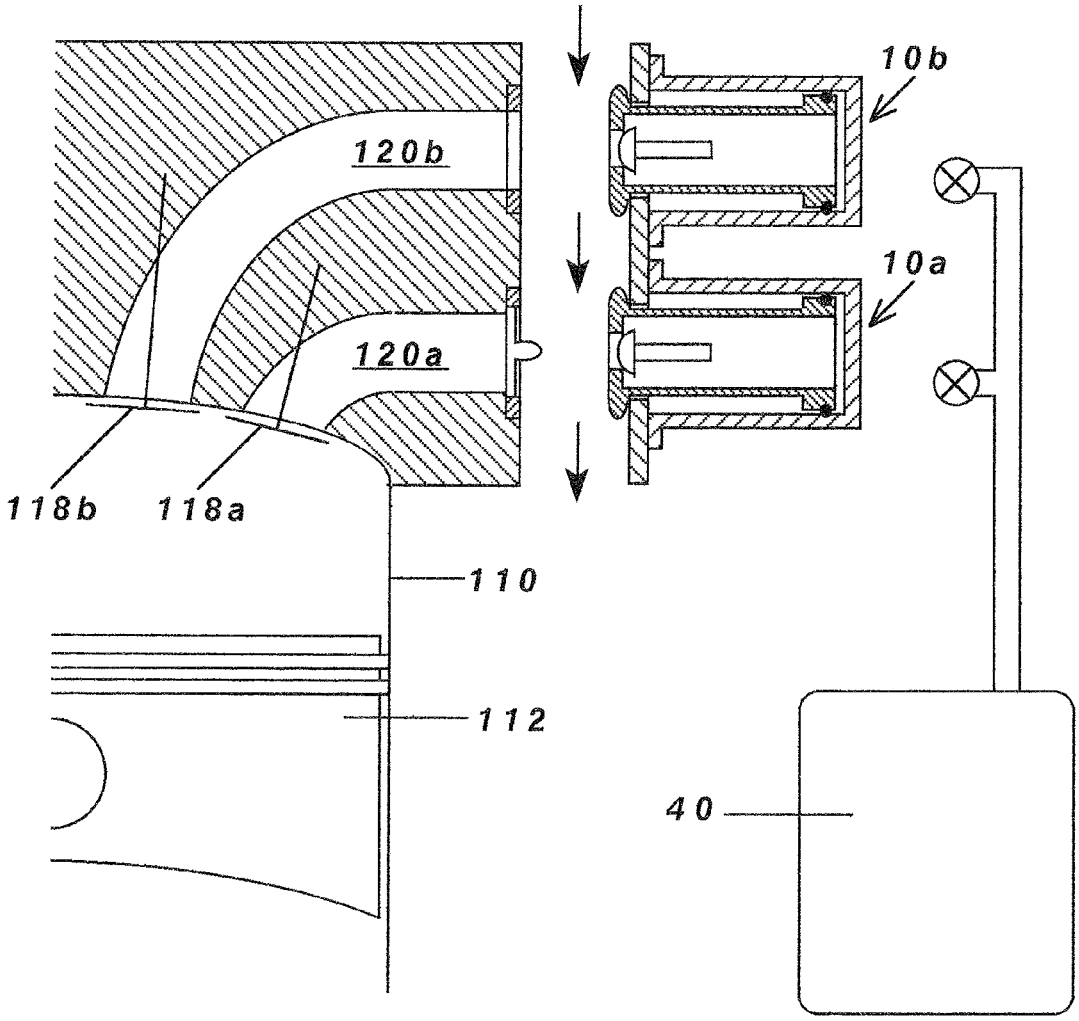
FIGS. 3, 4, 5 and 6 show one cylinder of an internal combustion engine with two intake ports and respective air connectors positioned for different operating modes.

FIG. 3 shows a cylinder 110 of a four-stroke internal combustion engine. The piston 112 reciprocates within the cylinder 110 to define a variable volume working chamber. The working chamber has two intake valves 118*a*, 118*b*. It also has an exhaust valve (not shown) and all the valves operate in a conventional manner. The air supply to the engine is ducted along an intake plenum in the direction of the flow arrows.

Intake ports 120*a*, 120*b* lead to the respective intake valves 118*a*, 118*b* and each port has a respective air connector 10*a*, 10*b* similar to that shown in FIG. 1 mounted opposite the port entrances. In such an engine, in addition to a normal mode of operation as shown in FIG. 3 in which fuel is burnt to generate power and both air connectors are in the open position so that the intake ports 120*a*, 120*b* communicate with the intake plenum, the engine is operable in at least one of two air hybrid modes, namely an air compressor mode shown in FIG. 4 and an air motor mode shown in FIG. 5.

Figure 4:
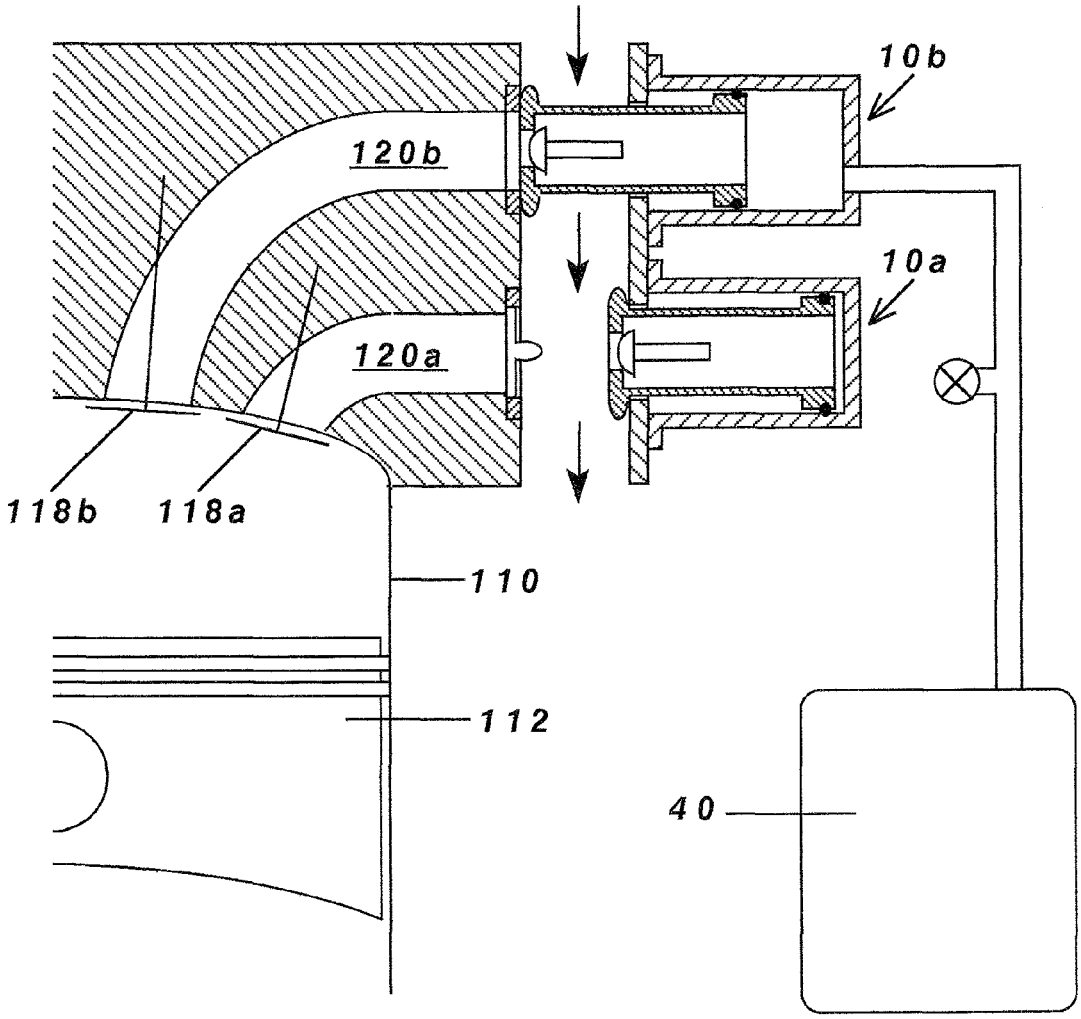

In FIG. 4, the engine operates in an air compressor mode in which air is drawn into the engine cylinder 110 during the intake stroke of the engine by way of the first intake port 120*a* with the air connector 10*a* in the open position, and this air is compressed and supplied by way of the second intake port 120*b* which is connected by the air connector 10*b* to the compressed air storage tank 40 during the ensuing compression stroke of the engine.

Figure 5:
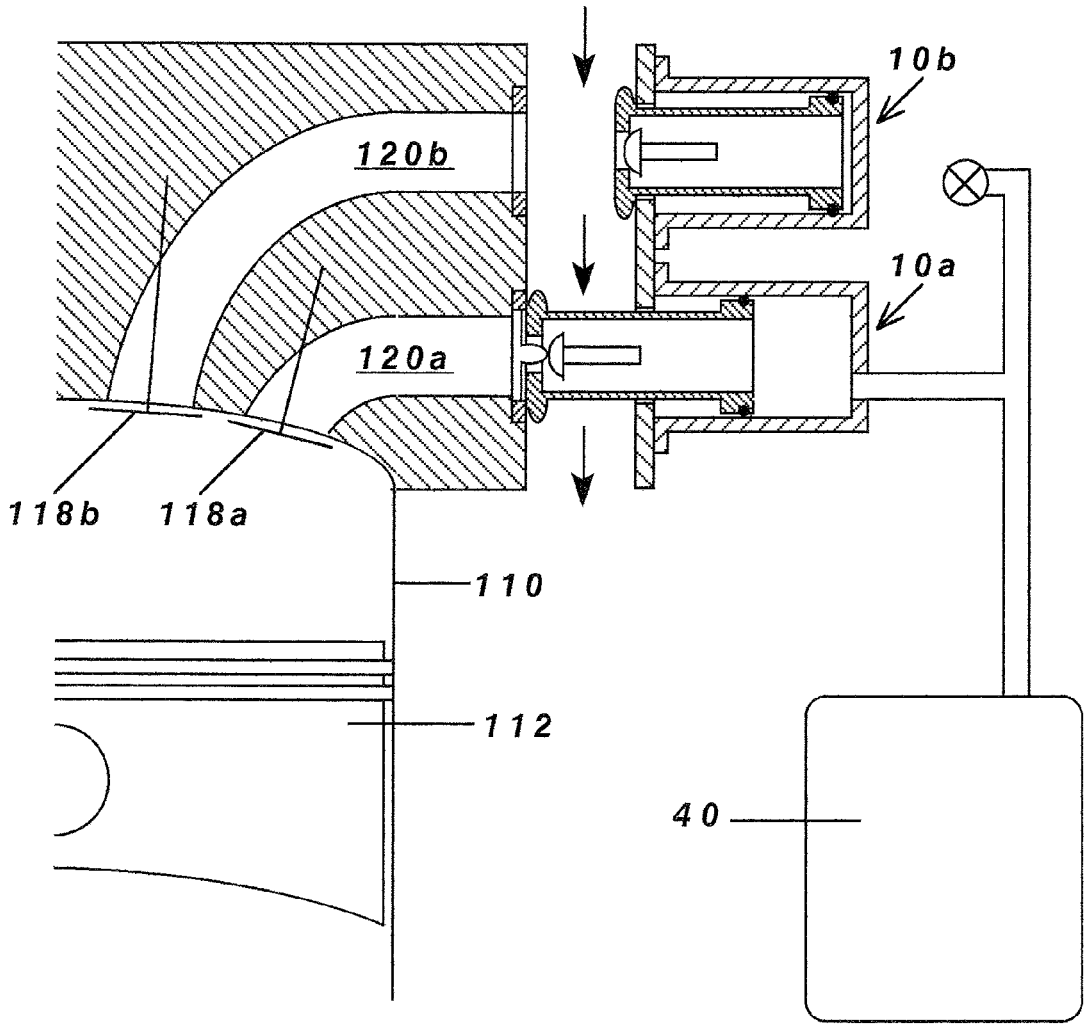

In FIG. 5, the engine operates in an air motor mode in which compressed air is supplied by way of the first intake port 120*a* which is connected by the air connector 10*a* working in conjunction with an externally mounted abutment to permit air flow from the compressed air storage tank 40 to the engine cylinder 110 during the intake stroke of the engine, and this air is discharged from the engine cylinder 110 during the ensuing compression stroke of the engine by way of the second intake port 120*b* with the air connector 10*b* in the open position.

Figure 8:
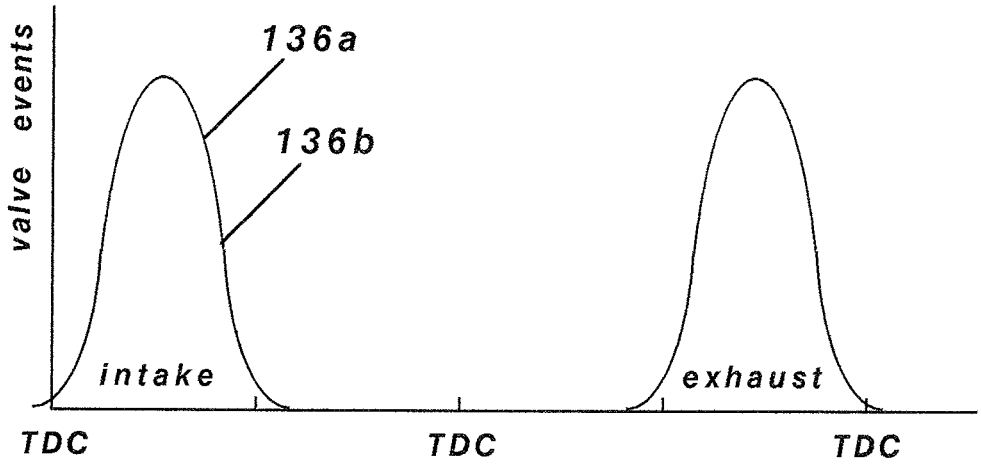
FIG. 8 is a valve timing diagram showing the valve events when the engine is operating in its normal power generating mode.
Figure 9:
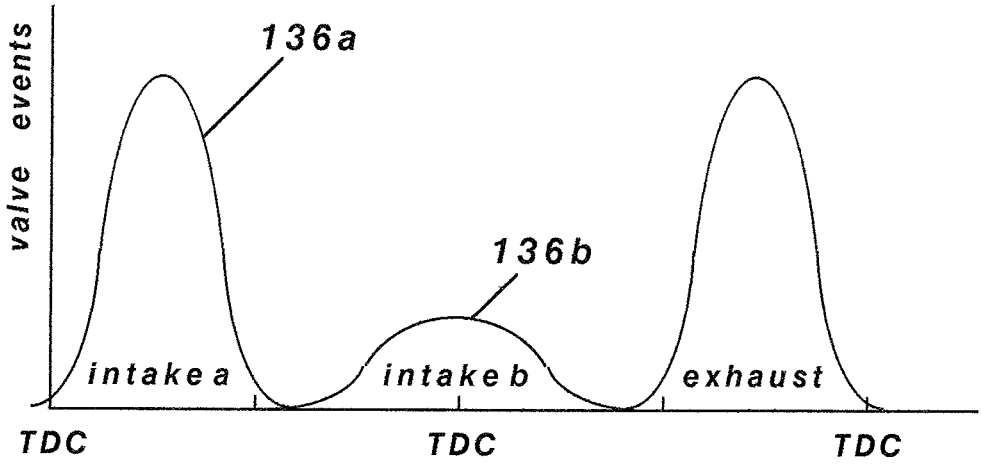
FIG. 9 is a valve timing diagram showing the valve events when the engine is operating in an air compressor mode or air motor mode.

The valve events of the above engine are shown in FIGS. 8 and 9. The first intake valve 118*a* is operated with a normal intake event 136*a* shown in FIGS. 8 and 9 during all modes of operation of the engine and the second intake valve 118*b* is operated with a first valve event 136*b* shown in FIG. 8 during the normal mode of operation of the engine and with a second valve event 136*b* shown in FIG. 9 during the air compressor and air motor modes of operation of the engine.

Figure 6:
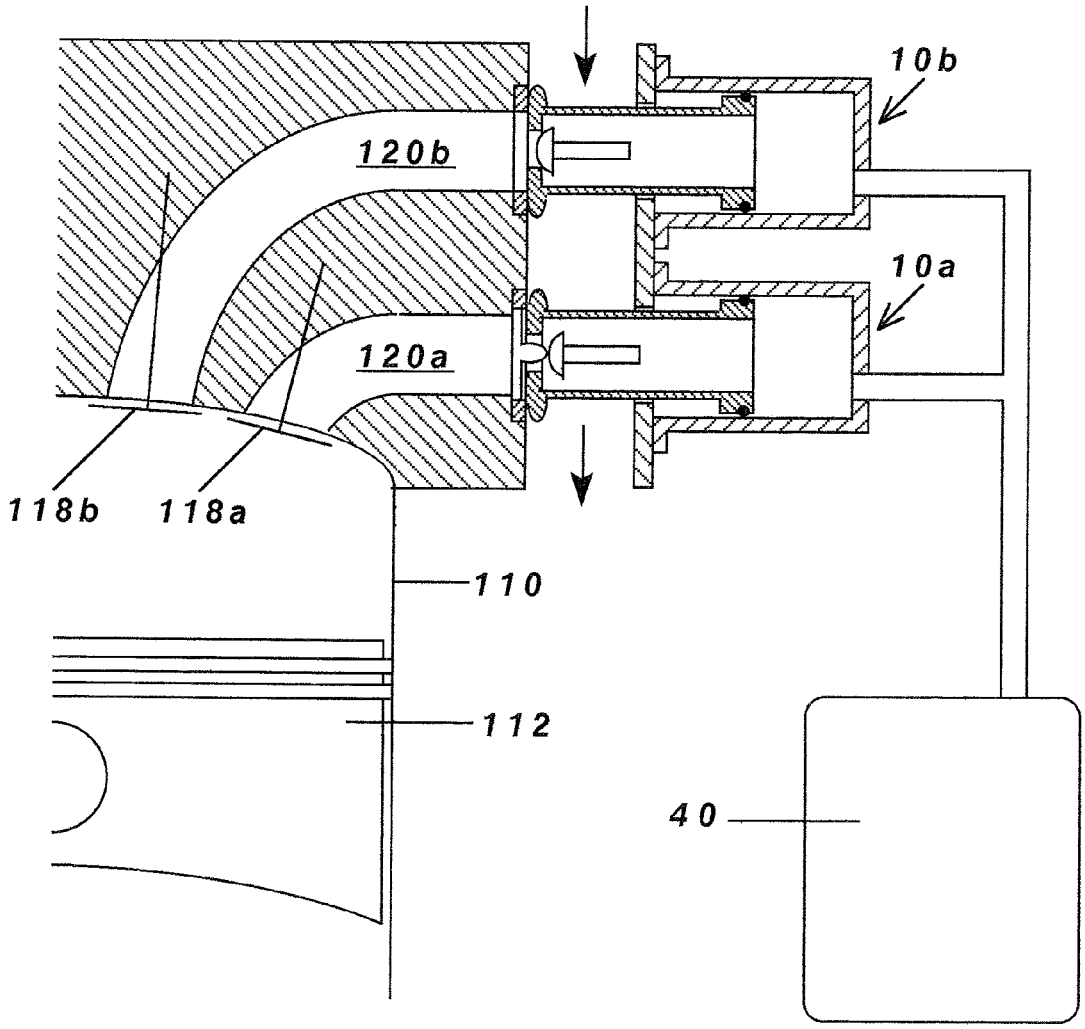

The above engine is also operable in another temporary boost, fuel burning mode for example to compensate for turbo lag or to provide short periods of high power operation. In this case, referring to FIG. 6, both air connectors 10*a*, 10*b* are in the closed position. Pressurised air is supplied to the engine cylinder 110 by way of the first intake port 120*a* which is connected to the compressed air storage tank 40 by the air connector 10*a* working in conjunction with an externally mounted abutment, while both intake valves 118*a*, 118*b* are operated with the valve events 136*a*, 136*b* for normal mode of operation of the engine shown in FIG. 8. The air connector 10*b* blocks the second intake port 120*b* and prevents escape of pressurised air to the intake plenum even though the second intake valve 118*b* is open during the intake stroke of the engine.

Figure 7:
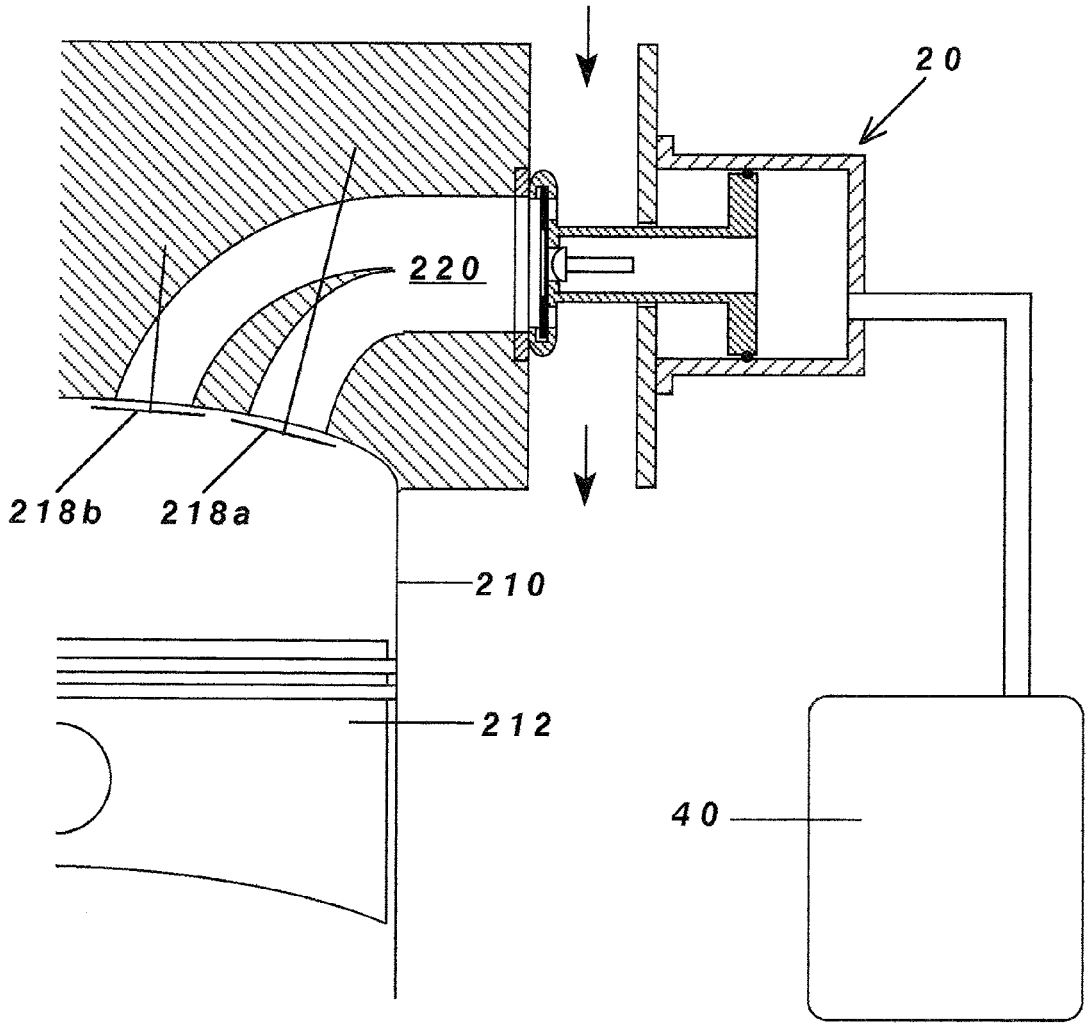
FIG. 7 shows one cylinder of another internal combustion engine with a single intake port and a single air connector positioned for the air compressor operating mode.

FIG. 7 shows another four-stroke internal combustion engine having two intake valves 218*a*, 218*b* sharing a common or siamesed intake port 220. The intake port 220 has an air connector 20 similar to that shown in FIG. 2 mounted opposite the port entrance. In such an engine, in addition to a normal mode of operation (not shown in FIG. 7) in which fuel is burnt to generate power and the air connector 20 is in the open position so that the intake ports 220 communicates with the intake plenum, the engine is also operable in an air compressor mode with the air connector 20 in the closed position shown in FIG. 7.

In FIG. 7, the engine operates in an air compressor mode in which air is drawn into the engine cylinder 210 during the intake stroke of the engine from the intake plenum by way of the non-return valve in the air connector 20, and this air is compressed and supplied by way of the check valve in the air connector 20 to the compressed air storage tank 40 during the ensuing compression stroke of the engine.

In the above engine, the first intake valve 118*a* is operated with a normal intake event 136*a* shown in FIGS. 8 and 9 during all modes of operation of the engine and the second intake valve 118*b* is operated with a first valve event 136*b* shown in FIG. 8 during the normal mode of operation of the engine and with a second valve event 136*b* shown in FIG. 9 during the air compressor mode of operation of the engine.

The above engine is also operable in another temporary boost, fuel burning mode for example to compensate for turbo lag or to provide short periods of high power operation. In this case, an air connector 10 or air connector 20 is mounted opposite the intake port 220 and in the closed position. Pressurised air is supplied to the engine cylinder 210 by way of the intake port 220 which is connected to the compressed air storage tank 40 by the air connector 10 or 20 working in conjunction with an externally mounted abutment, while both intake valves 218*a*, 218*b* are operated with the valve events for normal mode of operation of the engine.

The invention claimed is:

1. An air connector for use in a vehicle having a compressed air storage tank and an internal combustion engine having intake and exhaust ports connected to associated intake and exhaust pipes, the air connector comprising:

a rod formed with an air passage therein;

a stopper mounted on an end the rod, a portion of the air passage also extending therethrough;

a check valve movably arranged in the air passage of the rod and biased to seal the portion of the air passage extending through the stopper; and an actuator operable to move the stopper via the rod;

wherein the air connector serves to enable the tank to be filled with gases compressed by the engine, the air connector being mountable opposite an intake or an exhaust port within an associated intake or exhaust pipe; and wherein, during use of the air connector, the stopper is movable by the actuator between an open position in which the port communicates with the associated intake or exhaust pipe and a closed position in which the stopper isolates the port from the associated intake or exhaust pipe and establishes communication between the port and the tank by way of the air passage in the rod and the check valve.

2. The air connector of claim 1, wherein the actuator is a pneumatic actuator comprising a pneumatic air cylinder connectable to receive compressed air from the compressed air storage tank, and a piston having an opening communicating between the air passage in the rod and the pneumatic air cylinder, the piston having an effective area larger than the air blockage area of the stopper such that the closing force exerted on the piston by the air pressure in the pneumatic air cylinder exceeds the opening force exerted on the stopper by the air pressure transmitted to or generated within the blocked port.

3. An air connector as claimed in claim 2, further comprising a return spring to retract the stopper from the port entrance when the pneumatic air cylinder is disconnected from the compressed air storage tank and vented instead to the ambient atmosphere.

4. The air connector of claim 1, wherein the check valve includes a spring biased valve closure member operable to interact with an externally mounted abutment to allow air flow in both directions when the stopper is in the closed position.

5. The air connector of claim 1, further comprising at least one non-return valve located in an area of the stopper surrounding the rod to permit air flow between the port and the associated pipe when the stopper is in the closed position.

6. A four-stroke internal combustion engine comprising the air connector of claim 1 and two separate intake ports per cylinder leading to respective intake valves, wherein the air connector is mounted in an intake pipe or intake plenum opposite at least one of the intake ports of each cylinder.

7. A four-stroke internal combustion engine comprising the air connector of claim 1 and a single intake port per cylinder leading to at least one intake valve, wherein the air connector is mounted in an intake pipe or intake plenum opposite the intake port of each cylinder.

* * * * *